US009676527B2

(12) United States Patent
McCumber

(10) Patent No.: US 9,676,527 B2
(45) Date of Patent: Jun. 13, 2017

(54) TAMPER RESISTANT CONTAINER

(71) Applicant: Donald E. McCumber, Madison, WI (US)

(72) Inventor: Donald E. McCumber, Madison, WI (US)

(73) Assignee: PLACON CORPORATION, Madison, WI (US)

( * ) Notice: Subject to any disclaimer, the term of this patent is extended or adjusted under 35 U.S.C. 154(b) by 211 days.

(21) Appl. No.: 13/848,094

(22) Filed: Mar. 21, 2013

(65) Prior Publication Data

US 2014/0284346 A1 Sep. 25, 2014

(51) Int. Cl.

| | |
|---|---|
| ***B65D 41/16*** | (2006.01) |
| ***B65D 43/14*** | (2006.01) |
| ***B65D 43/16*** | (2006.01) |

(52) U.S. Cl.

CPC .... *B65D 43/162* (2013.01); *B65D 2101/0092* (2013.01)

(58) Field of Classification Search

CPC .. B65D 17/161; B65D 17/163; B65D 17/165; B65D 2543/00296; B65D 2543/00351; B65D 43/16; B65D 43/161; B65D 43/162; B65D 45/16; B65D 45/18; B65D 45/20

USPC ..... 220/265, 266, 268–270, 4.21–4.24, 792, 220/794, 780, 801–802, 805

See application file for complete search history.

(56) References Cited

U.S. PATENT DOCUMENTS

| | | | | |
|---|---|---|---|---|
| 3,674,295 | A * | 7/1972 | Padovani | 292/76 |
| 4,576,330 | A * | 3/1986 | Schepp | 220/315 |
| 5,169,014 | A * | 12/1992 | Hexamer | 220/4.22 |
| 5,584,408 | A * | 12/1996 | Orkisz | 220/4.23 |
| 5,699,913 | A * | 12/1997 | Richardson | 206/470 |
| 5,788,105 | A * | 8/1998 | Foos | B65D 43/162 206/1.5 |
| 5,897,011 | A * | 4/1999 | Brilliant et al. | 220/4.23 |
| 6,572,909 | B1 | 6/2003 | Bagwell et al. | |
| 7,073,680 | B2 * | 7/2006 | Boback et al. | 220/266 |
| 7,284,673 | B2 * | 10/2007 | Habeger et al. | 220/4.23 |
| D585,735 | S | 2/2009 | Vovan et al. | |
| D587,993 | S | 3/2009 | Vovan | |
| 7,568,589 | B2 | 8/2009 | Vovan | |
| D601,013 | S * | 9/2009 | Petitjean | D9/426 |

(Continued)

FOREIGN PATENT DOCUMENTS

DE 7816353 U1 11/1978

*Primary Examiner* — Anthony Stashick
*Assistant Examiner* — Kaushikkumar Desai
(74) *Attorney, Agent, or Firm* — Stiennon & Stiennon

(57) ABSTRACT

A clamshell container has a lid connected to a base by an integral hinge. The lid has a perimeter projecting member which engages with a peripheral base sealing wall in a closed configuration so that it is difficult for a user to open the container without tearing the lid along a weakened region of material along the hinge. To aid in resisting undetectable tampering, the container has a post which projects from the side wall and extends less than the length of the side wall within the container. The post has an engaging wall which faces towards a base sealing wall and which is spaced from the sealing wall to define a gap which receives the closed lid's projecting member. Distortion of the closed container which tends to urge the lid projecting member away from the base sealing wall engages it with the post engaging wall to resist tampering.

2 Claims, 2 Drawing Sheets

(56) References Cited

U.S. PATENT DOCUMENTS

| | | | | |
|---|---|---|---|---|
| 7,597,206 | B2 * | 10/2009 | Atkins et al. | 220/4.23 |
| 7,712,626 | B2 | 5/2010 | Vovan | |
| 8,127,961 | B2 | 3/2012 | Vovan | |
| 8,807,385 | B1 * | 8/2014 | Fosse | 220/691 |
| 2001/0002268 | A1 * | 5/2001 | Hanson et al. | 426/106 |
| 2003/0192888 | A1 * | 10/2003 | Chang | B65D 43/162 220/4.23 |
| 2007/0045317 | A1 * | 3/2007 | Rosender et al. | 220/266 |
| 2008/0087669 | A2 | 4/2008 | Boback et al. | |
| 2009/0321463 | A1 | 12/2009 | Vovan | |
| 2010/0072217 | A1 * | 3/2010 | Parikh et al. | 220/833 |
| 2012/0031921 | A1 * | 2/2012 | Cadiente | B65D 43/162 220/835 |
| 2012/0048774 | A1 * | 3/2012 | Gingras et al. | 206/565 |
| 2012/0181280 | A1 | 7/2012 | Barbier et al. | |

* cited by examiner

TAMPER RESISTANT CONTAINER

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to clamshell containers in general, and more particularly to molded plastic containers with tamper-resistant features.

Many food items are displayed to customers in transparent plastic clamshell containers. These containers are often filled and often sealed by hand and may contain fresh food such as bakery or prepared fruit and vegetable servings. These pre-filled containers may then be placed in retail areas for direct examination and selection by the customer. Because these food products are not under the direct supervision of store personnel at all times, customers may be concerned that the contents of the containers have not been adulterated, diminished, or otherwise tampered with. Although access to the container contents can be absolutely restricted by a permanent seal, such as by ultrasonic or heat sealing, such an approach has the downside of requiring costly equipment to effectuate, and may be inconvenient for the customer to access after the purchase has been made. Tamper-evident containers have been developed which do not foreclose access to the container contents, but which do give ready evidence that tampering has taken place. If the container bears indications in its appearance that the package has been opened after its initial stocking with goods, a customer may choose to pass that container by, and select one that has no indication of being tampered with.

One approach to providing this evidence is the clamshell container with a lid which is connected by an integral hinge to a base. The lid has a perimeter structure which secures in a press fit to a mating base sealing structure. The lid has a narrow flange which overlies a base flange, and which is too narrow to readily be gripped and displaced by a user. In order to open such a container, the user grips a protruding tab extending from the lid in the region of the hinge, and pulls up in order to sever the lid from the base along a region of weakened material such as a perforation between the lid and the base. The fact that the connection between the base and the lid is not intact gives indication to the attentive would-be purchaser that the container has been compromised. However, there are maneuvers a tamperer can use to release the lid from the base without severing the lid from the base. For example, if the sides of the container are gripped in the opposed hands of a tamperer and rotated in opposite directions, the projecting member of the lid can be distorted to pull away from the base, thereby breaking the resilient seal between the base and the lid. Moreover, if downward pressure is applied to the lid close to the peripheral seal with the base, the lid can be distorted downwardly and made to pull away from the base perimeter, again, largely defeating the package tamper-evident features.

What is needed is a container which can be securely yet releasably closed in such a fashion that tampering with the container to destroy the integrity of the initial filling of the container is made evident.

SUMMARY OF THE INVENTION

The thermoformed thermoplastic clamshell container of this invention has a lid which is connected to a base by an integral hinge. A weakened region of material such as a perforation is provided near the hinge. The lid has a perimeter projecting member which engages with a peripheral base sealing wall in a closed configuration to secure the lid to the base in such a fashion that it is difficult for a user to open the container without tearing the lid along the weakened region of material along the hinge. To aid in resisting undetectable tampering, the container base has one or more posts which project from one or more of the base side walls. Each post is relatively narrow and extends less than the length of the base side wall within the container. Each post has an engaging wall which faces towards a base sealing wall and which is spaced from the sealing wall by a connecting wall to define a gap which receives the closed lid's projecting member. Distortion of the closed container which tends to urge the lid projecting member away from the base sealing wall, such as a downward depression of the lid, or a racking of the entire container, rather than causing the lid projecting member to separate from its engagement with the base sealing wall, distorts the lid inwardly until an internal wall of the lid projecting member engages against the engaging walls of the post, thereby making it more difficult to force entry into the container without distorting it in such a manner as to leave an evident sign of tampering.

It is an object of the present invention to provide a clamshell plastic container which has structures which resist the separation of the lid from the base.

It is another object of the present invention to provide a clamshell container which has structures which resist racking of the container which would tend to separate the lid from the base.

Further objects, features and advantages of the invention will be apparent from the following detailed description when taken in conjunction with the accompanying drawings.

DESCRIPTION OF THE PREFERRED EMBODIMENTS

Figure 1:
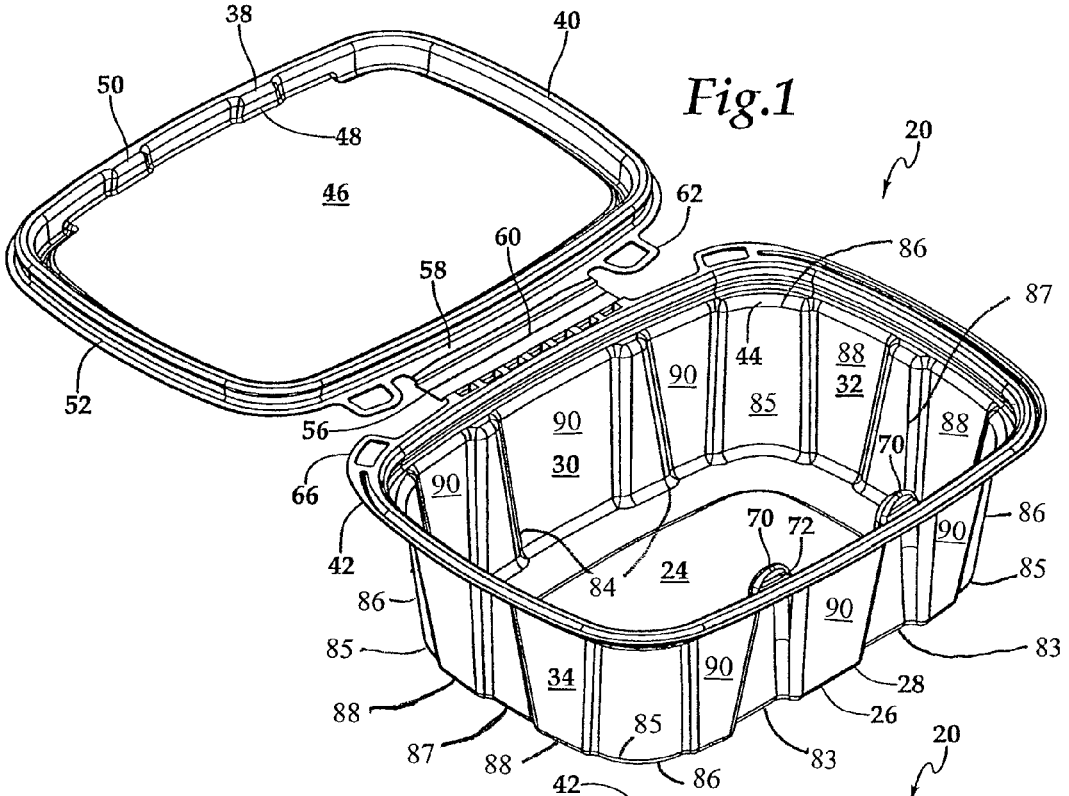
FIG. 1 is an isometric view of an open container of this invention.
Figure 2:
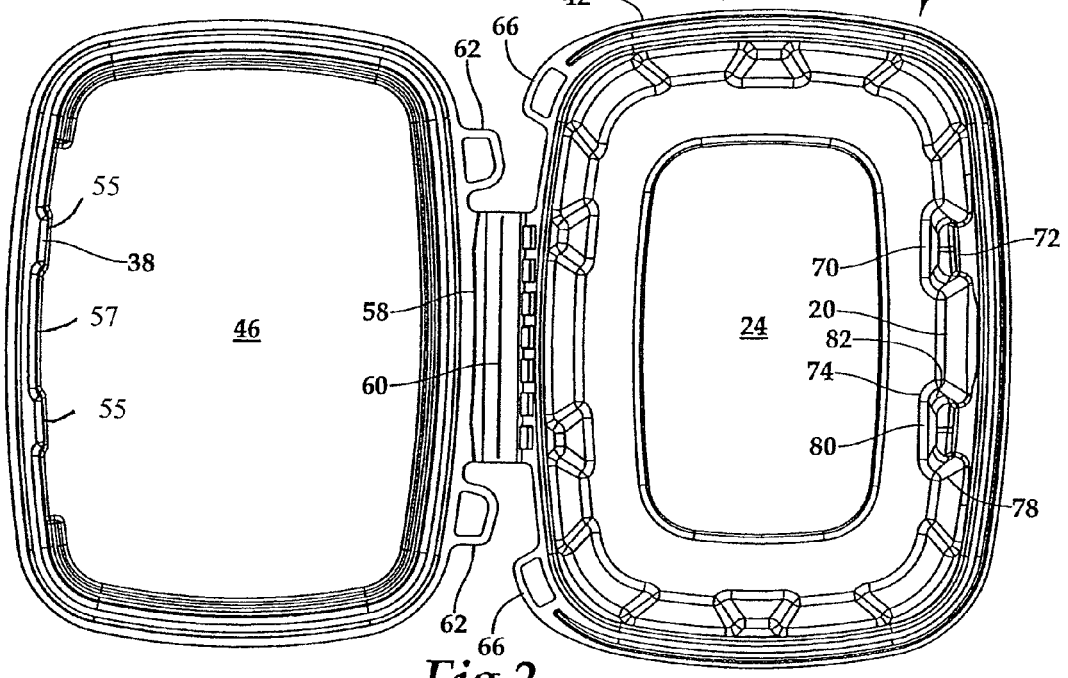
FIG. 2 is a top plan view of the container of FIG. 1.
Figure 3:
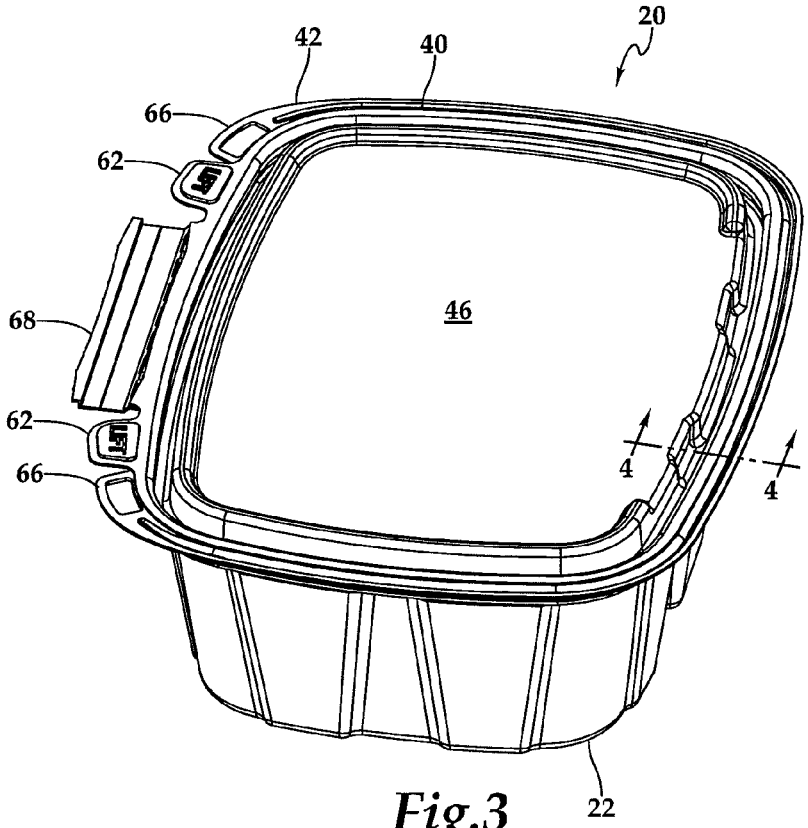
FIG. 3 is a perspective view of the container of claim 1 after it has been closed and reopened, showing the warning projection indicating tampering or previous opening.
Figure 4:
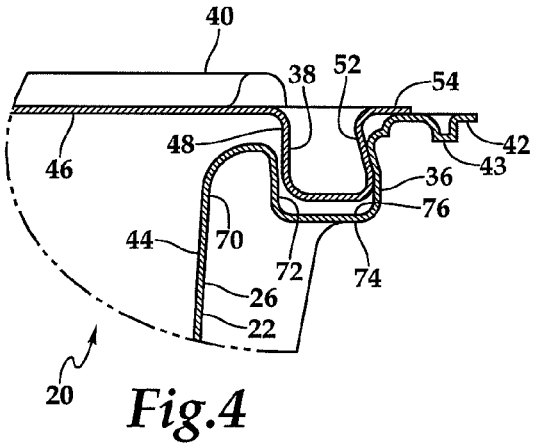
FIG. 4 is a cross-sectional view of the container of FIG. 3 taken along section line 4-4, showing the configuration of the engagement between the base and the lid prior to the first opening of the container.

Referring more particularly to FIGS. 1-5, wherein like numbers refer to similar parts, a clamshell container 20 of this invention is shown in an open condition in FIG. 1 prior to being filled with contents and closed for the first time. The container 20 may be formed of RPET, PET, HIPS, high density polyethylene, polyurethane, or other suitable plastic material in a single sheet thermoforming process. The thermoformed sheet material will generally be from about 0.007 inches thick to 0.07 inches thick. The container has a base 22 with a bottom wall 24 from which a side wall 26 extends upwardly. The side wall may take on a variety of shapes, but in a generally rectangular container will be comprised of a front wall 28, a rear wall 30, and a right wall 32 and a left wall 34 extending between the front and rear walls. The upper perimeter of the side wall 26, as shown in FIG. 3, has a sealing segment 36 which may be somewhat undercut, to form a seal when the projecting member 38 of a lid 40 is closed upon the base. The sealing segment 36 extends upwardly to terminate in an outwardly extending peripheral flange 42. The flange may be provided with a downwardly protruding stiffening bead 43 as shown in FIG. 4. The bottom wall 24 and the side wall 26 define an internal cavity 44 which receives the product for which the container is intended.

As shown in FIG. 1, the lid 40 has a top wall 46 from which the projecting member 38 extends. The projecting member 38 has a downwardly extending internal wall 48 connected by an outwardly extending median segment 50 to an upwardly extending external wall 52 which terminates in an outwardly extending lid flange 54. As shown in FIG. 2, the internal wall 48 is continuous with two post contact segments 55 which are spaced inwardly from continuous connecting segments 57. The lid 40 is connected to the base by an integrally formed hinge 56 which extends between the lid flange 54 and the base flange 42. The hinge 56 may be defined by a coined, stamped, or perforated section of plastic, or some other weakened region of material which facilitates the folding of the lid about a hinge axis 60 in alignment for sealing to the base. As best shown in FIG. 2, a separation line 58 is located between the hinge axis 60 and the lid projecting member 38. The separation line 58 may be a perforation or some other weakened material region, and it is preferably non-linear or comprised of plural segments. The degree of weakening of the separation line 58 is chosen to be greater than that of the hinge axis 60, such that when a tearing force is applied to the lid, it will preferentially separate along the separation line 58 over the hinge axis 60. Lid finger tabs 62 extend from the lid flange on either side of the hinge 56, and base finger tabs 66 extend from the base flange outwardly of the lid finger tabs. The finger tabs 62, 66, provide convenient gripping access to the base and lid, to provide for the ready separation of the lid from the base. Once the lid has been separated from the base, a flap of material 68 extends from the line of the hinge axis. This outwardly extending flap of material 68 gives a visible signal to prospective purchasers that the container has been opened after its initial sealing, as shown in FIG. 3.

For loading the container with product, the lid is pivotable about the hinge axis between an open configuration, shown in FIG. 1, in which the internal cavity is accessible for introduction of product, and a closed configuration, in which the lid perimeter projecting member closes the container to restrict access to the internal cavity.

As shown in FIGS. 1 and 2, portions extend from the front wall 28 of the base side wall 26 to define two upwardly projecting internal posts 70. The posts 70 extend upwardly away from the bottom wall 24. Each post extends along the side wall 26 less than the length of the entire side wall, so as to not reduce too greatly the interior capacity of the container 20. As shown in FIG. 4, each post 70 has an engaging wall 72 which faces towards the base side wall sealing segment 36 and which is spaced from the sealing segment by a connecting wall 74 to define a gap 76. When the lid is closed on the base the lid perimeter projecting member 38 portions of the projecting member extend into the gap 76, and the external wall 52 of the projecting member engages with and is distorted by engaging the sealing segment 36. The lid 40 in this configuration is secured to the base 22. In an undistorted closed condition, the post engaging wall 72 is spaced from the lid projecting member 38.

Figure 5:
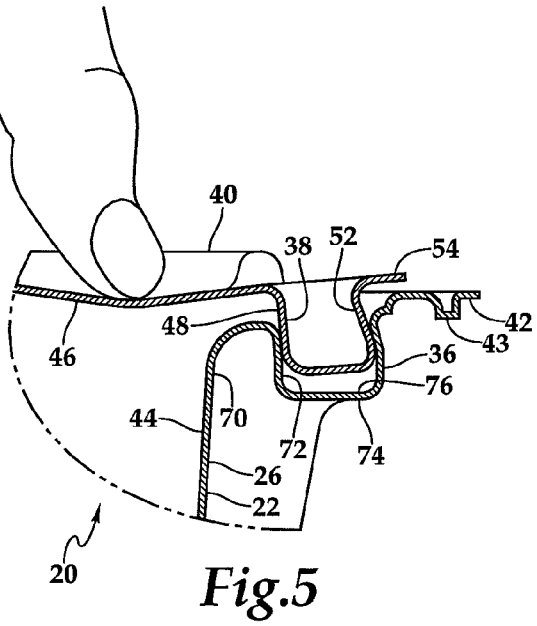
FIG. 5 is a cross-sectional view of the container of FIG. 3 showing the engagement between the lid projection and the base posts to interfere with attempted tampering.

In this closed configuration, the ordinary way to open the container is to engage the finger tabs, tear the lid along the weakened separation region, and pull the lid off in a fashion that leaves the flap of material 68 projecting as a sign that the package has been opened after filling. Some attempts by a tamperer to separate the lid from the base by distorting the package without tearing off the lid are resisted by the engagement of the posts 70 with the lid. As shown in FIG. 5, if a tamperer attempts to pull the external wall 52 of the lid projecting member 38 away from the base side wall sealing segment by pressing down on the lid top wall 46, the internal wall 48 of the lid projecting member will be driven inwardly, however, the course of this travel will be obstructed from substantial inward travel by engagement with the engaging wall 72 of a post. Likewise, if the tamperer attempts to twist or rack the container by pushing down on one quadrant of the container while pushing up on an opposite corner, the posts will block excessive racking by engaging the posts with the lid. The container thus resists distortion of the container in a closed configuration which tends to urge the lid projecting member away from the base sealing wall when the lid projecting member internal wall engages the post engaging wall.

As shown in FIG. 2, each post has a first wall 78 which extends inwardly from the side wall 26, a second wall 80 which extends from the first wall 78 generally parallel to the remainder of the side wall, and a third wall 82 which extends from the second wall back to the side wall. Also to be noted are the front and rear walls 28, 30 have two indented sections 83, 84 and the left and right walls 34, 32 each have one indented section 87. The left and right walls 34, 32 are connected to the front and rear walls 28, 30 by an indented curved section 85 of the upwardly extending side wall 26 to form one of four corners 86 of the upwardly extending side wall. Further the left wall and right walls 34, 32 indented sections 87 divide the left and right walls into two portions 88. Likewise the front and rear walls 28, 30 two indented sections 83, 84 divide the front and rear walls into three portions 90.

It should be noted that although two posts have been shown on the front wall, one or more posts may be employed, depending on the size of the container. Posts may also be provided along other portions of the side wall.

It is understood that the invention is not limited to the particular construction and arrangement of parts herein illustrated and described, but embraces all such modified forms thereof as come within the scope of the following claims.

I claim:

1. A clamshell container comprising:

a base (22) having a bottom wall (24) having an upwardly extending side wall (26) having an upwardly extending sealing segment (36) from which an outwardly extending peripheral flange (42) extends, wherein an internal cavity (44) is defined above the bottom wall (24) and within the side wall (26);

wherein the base upwardly extending side wall (26) is formed by a left wall (34), a right wall (32), connected between a front wall (28) and a rear wall (30);

wherein the left wall (34) and the right wall (32) are connected to the front wall (28) and the rear wall (30) by an indented curved section (85) of the upwardly extending side wall (26) to form one of four corners (86) of the upwardly extending side wall (26);

wherein the left wall (34) and the right wall (32) have an indented section (87) between two of the four indented curved sections (85), and dividing the left wall and the right wall in to two portions (88);

wherein the front wall (28) and the rear wall (30) have two indented sections (83) between two of the four indented curved sections (85), and dividing the front wall and the rear wall into three portions (90);

wherein the two indent sections are indented to extend into the internal cavity (44);

a lid (40) having a top wall (46) and a projecting member (38) on the lid (40) which seals to the base (22), the projecting member (38) extends away from the top wall (46) toward the internal cavity of container (44) when the clamshell container (20) is closed and is sized to fit with the upwardly extending sealing segment (36) to form a seal;

a hinge (56) integrally formed with the lid and connecting the lid (40) to the base rear wall (30) the hinge (56) defining a hinge axis (60);

a line of weakened material (58) extending across the hinge (56) to defining a line of separation (58) between the hinge axis (60) and the lid (40);

two first finger tabs (62) extending from the lid (40) on the same side of the lid (40) as the hinge (56) and spaced on either side of the hinge (56);

two second finger tabs (66) extending from portions of the outwardly extending peripheral flange (42) on the base wall (24);

wherein each of the first finger tabs (62) is adjacent to one of the second finger tabs (66) but not overlapping with said one of the second tabs (66);

portions of the lid perimeter projecting member (38) defining a continuous internal wall facing inwardly (48), and an external wall (52) which faces outwardly and engages the base inwardly facing sealing segment (36) of base side wall (26), the external wall (52) engageable with the base sealing segment (36) in the closed configuration;

wherein the two indented sections (83) of the front wall (28) extend further into the internal cavity (44) than the two indented sections (84) of the rear wall (30) and extend further toward the lid (40) to become two sided and to form internal posts (70) extending upwardly from the bottom wall (24), and the posts (70) each having engaging walls (72) which face toward the base wall sealing segment (36) and which is spaced from sealing segment (36) by connecting walls (74) which define a gaps (76) therebetween;

wherein in the portions of the lid projecting member (38) downwardly extending internal wall (48) of lid (40) projecting member (38) continuous internal wall (48) form two inwardly extending post contact segments (55) one of which faces and is closely spaced from each of the engaging walls (72) of one of the upwardly projecting posts (70).

2. The container of claim 1 further comprising portions of the projecting member continuous internal wall extending above the top wall that forms a ridge in the top wall which opens toward the front wall.

* * * * *